US006160356A

United States Patent [19]

Shimada

[11] Patent Number: 6,160,356

[45] Date of Patent: Dec. 12, 2000

[54] STROBO SYSTEM USED FOR CAMERA

[75] Inventor: Yoshinao Shimada, Hachioji, Japan

[73] Assignee: Olympus Optical Co., Ltd., Tokyo, Japan

[21] Appl. No.: 09/149,005

[22] Filed: Sep. 8, 1998

[30] Foreign Application Priority Data

Sep. 9, 1997 [JP] Japan ..... 9-244481
Sep. 9, 1997 [JP] Japan ..... 9-244482
Sep. 9, 1997 [JP] Japan ..... 9-244488

[51] Int. Cl.[7] ..... H05B 39/00

[52] U.S. Cl. ..... 315/241

[58] Field of Search ..... 315/241 S, 241 R, 315/241 P, 214, 215, 224, 225, 200 A, 291, 274, 276; 396/205

[56] References Cited

U.S. PATENT DOCUMENTS

Re. 36,239 6/1999 Kobayashi et al. ..... 396/206
4,005,337 1/1977 Rabe ..... 315/241 S
4,591,762 5/1986 Nakamura ..... 315/241 P
4,949,017 8/1990 Sikora ..... 315/219
5,714,847 2/1998 Lindauer et al. ..... 315/307

*Primary Examiner*—Don Wong
*Assistant Examiner*—Ephrem Alemu
*Attorney, Agent, or Firm*—Pillsbury Madison & Sutro LLP

[57] ABSTRACT

When the charging voltage across a main capacitor 29, as detected by a charging voltage detector 36, is below a predetermined level, the "on" period pulse duration of the strobo pulse signal from a strobo signal generator 35 for driving an oscillating transformer 13, is reduced compared to the case when the detected charging voltage is above the predetermined level. When a high current load is applied to a power supply 1 in such case as when driving a zoom motor, the CPU 101 tentatively stops the charging of the main capacitor by reducing the "on" period pulse duration of the strobo pulse signal from the strobo pulse signal generator 35 for driving the oscillating transformer 13 or extend the pulse cycle of the strobo pulse signal, or controlling a charging signal generator 34.

8 Claims, 12 Drawing Sheets

STROBO SYSTEM USED FOR CAMERA

BACKGROUND OF THE INVENTION

The present invention relates to improvements in strobo system used for cameras and, more particularly to a strobo system which has a circuit for exciting a transformer for charging a main capacitor in a non-self-excited fly-back system.

Recently, various electronic still cameras of internal strobo type, which use a strobo charging circuit of non-self-excited fly-back type, have become popular owing to their readiness for current control.

In the strobo charging circuit of the non-self-excited fly-back type, a charging voltage of a main capacitor is generated by an oscillating transformer which generates sharp changes of the coil current in response to the application of a predetermined pulse voltage. In an initial stage of charging, however, the oscillating transformer is more or less subject to the phenomenon of saturation and resultant generation of inrush current and increase of current consumption. This phenomenon deteriorates the charging efficiency and, depending on the setting of the charging pulse signal, leads to the operation failure of the system having the charging circuit due to the inrush current.

In such a strobo charging circuit of the non-self-excited fly-back type, referring to FIG. 8, when the "on" period pulse duration of a pulse voltage (labeled strobo pulse signal in the Figure) applied to the oscillating transformer in the strobo charging circuit is substantially equal, with as low terminal voltage across the main capacitor as zero to several ten volts, i.e., in an initial stage of charging, to the pulse duration t0 in the normal charging state, the following phenomenon arises.

When the "on" period pulse duration of the strobo pulse signal in an initial stage of charging is substantially equal to that in the normal charging state, the oscillating transformer may be magnetically saturated, causing an over-current (i.e., inrush current) (designated at A in the Figure) to flow through the primary side. This phenomenon arises since the pulse duration t0 is too long in correspondence to the charging voltage across the main capacitor. In this case, the secondary side current (designated at B in the Figure) is not used up on one cycle, resulting in energy accumulation in the transformer. The inrush current flows so long as this energy accumulation is continued.

The inrush current increases the current consumption, leading to reduction of the supply voltage and failure of operation of a control circuit of the system, which is furnished with power from the same power supply as for the strobo charging circuit.

As means for overcoming this drawback, it is well known in the art to suppress the magnetic saturation as a cause of the over-current by limiting the "on" period pulse duration of the pulse voltage to a relatively short period t, as shown in FIG. 9. However, continuing the oscillation of the oscillating transformer with the reduced "on" period pulse duration, gives rise to a drawback that the charging time is extremely increased, although the inrush current can be reliably suppressed.

In the meantime, to cope with a recent trend for reducing camera size, in many camera systems with such a strobo charging circuit the power supply for charging the main capacitor is also used for driving various actuators in the camera system and for supplying power to various control circuit of the camera.

Recently, however, a large variety of actuators are mounted in the camera, leading to a demand for high current supply capacity power supplies. On the other hand, size reduction of the power supply itself is another demand. Therefore, it is difficult to mount a power supply, which can withstand over-load.

When driving an actuator or the like, the common power supply bears a high load, and the power supply voltage is tentatively reduced.

In the meantime, it is desired to charge the main capacitor of the strobo charging circuit quickly and accurately. For this reason, the main capacitor is charged concurrently when driving various actuators or the like in the camera.

If any actuator is driven without concurrent charging of the main capacitor, the extent of the power supply voltage reduction not such as to give rise to any problem. However, when the actuator is driven while concurrently charging the main capacitor, the load on the power supply may exceed a rating, giving rise to various problems such as operation failure of the system.

SUMMARY OF THE INVENTION

It is an object of the present invention to provide a strobo system, which can reduce the time of charging the main capacitor while suppressing inrush current when causing oscillation of the transformer for charging the main capacitor in the non-self-excited fly-back system.

It is another object of the present invention to provide a strobo system, which can suppress inrush current when causing oscillation of the transformer for charging the main capacitor in the non-self-excited fly-back system without extending the time for charging the main capacitor.

It is a further object of the present invention to provide a strobo system, which can evade an over-load state of its common power supply when causing oscillation of the transformer for charging the main capacitor in the non-self-excited fly-back system.

According to a first aspect of the present invention, there is provided a strobo system comprising a main capacitor for storing charge for causing light emission of a strobo tube, a transformer with the secondary side thereof connected across the main capacitor for charging the same, an exciting pulse generator for exciting the transformer by supplying a pulse voltage to the primary side of the transformer, and power supply circuit for supplying power to the exciting pulse circuit, which further comprises charging voltage detecting means for detecting the charting voltage across the main capacitor, the exciting pulse generator being constructed such that, when the charging voltage detected by the charging voltage detecting means is relatively high, its output pulse generation is controlled such as to increase the pulse duration of the output pulse or reduce the pulse cycle thereof.

According to a second aspect of the present invention, there is provided a strobo system comprising a main capacitor for storing charge for causing light emission of a strobo tube, a transformer with the secondary side thereof connected across the main capacitor for charging the same, an exciting pulse generator for exciting the transformer by supplying a pulse voltage to the primary side of the transformer, and power supply circuit for supplying power to the exciting pulse circuit, which further comprises supply voltage detecting means for detecting the supply voltage of the power supply circuit, the exciting pulse generator being constructed such that, when the charging voltage detected by the charging voltage detecting means is relatively low, its output pulse generation is controlled such as to increase the pulse duration of the output pulse or reduce the pulse cycle thereof.

According to a third aspect of the present invention, there is provided a strobo system comprising a main capacitor for storing charge for causing light emission of a strobo tube, a transformer with the secondary side thereof connected across the main capacitor for charging the same, an exciting pulse generator for exciting the transformer by supplying a pulse voltage to the primary side of the transformer, and power supply circuit for supplying power to the exciting pulse circuit, which further comprises charging voltage detecting means for detecting the charging voltage across the main capacitor, the exciting pulse generator being constructed such that, when the charging voltage detected by the charging voltage detecting means is below a predetermined level, its output pulse generation is controlled such as to reduce the pulse duration of the output pulse or increase the pulse cycle thereof in comparison to the case when the detected charging voltage is above the predetermined level.

According to a fourth aspect of the present invention, there is provided a strobo system comprising a main capacitor for storing charge for causing light emission of a strobo tube, a transformer with the secondary side thereof connected across the main capacitor for charging the same, an exciting pulse generator for exciting the transformer by supplying a pulse voltage to the primary side of the transformer, and power supply circuit for supplying power to the exciting pulse circuit, wherein the exciting pulse generator is constructed such that its output pulse generation is controlled such that, around an instant before the lapse of a predetermined time from the instant generation of its output pulse, the pulse duration of the output pulse is reduced or the pulse cycle thereof is increased.

According to a fifth aspect of the present invention, there is provided a strobo system comprising a main capacitor for storing charge for causing light emission of a strobo tube, a transformer with the secondary side thereof connected across the main capacitor for charging the same, an exciting pulse generator for exciting the transformer by supplying a pulse voltage to the primary side of the transformer, and power supply circuit for supplying power to the exciting pulse circuit, which further comprises power supply state checking means for checking whether power has been supplied from the power supply circuit to a particular one of the other loads, the exciting pulse generator being constructed such that, when the power supply state detecting means is detecting that power is being supplied to the particular load, its output pulse generation is controlled such as to reduce the pulse duration of the output pulse or increase the pulse cycle thereof.

According to a sixth aspect of the present invention, there is provided the strobo system according to the fifth aspect, wherein the power supply state detecting means is constructed such as to detect, according to the output voltage of the power supply circuit, the power supplication to the particular load.

According to a seventh aspect of the present invention, there is provided the strobo system according to the fifth aspect, wherein the power supply detecting means is constructed such as to detect, on the basis of recognition of a system control unit for collectively controlling the state of power supply in the strobo system, the power supplication to the particular load.

According to an eighth aspect of the present invention, there is provided a strobo system comprising a main capacitor for storing charge for causing light emission of a strobo tube, a transformer with the secondary side thereof connected across the main capacitor for charging the same, an exciting pulse generator for exciting the transformer by supplying a pulse voltage to the primary side of the transformer, and power supply circuit for supplying power to the exciting pulse circuit, which further comprises supply voltage detecting means for detecting the supply voltage from the power supply circuit, and a power supply kind detecting means for detecting that a particular power supply having a relatively low internal impedance is used, the exciting pulse generator being constructed such that, when the supply voltage detected by the supply voltage detecting means is above a predetermined value, or when the power supply kind detecting means has detected that the particular power supply is used, its output pulse generation is controlled such as to set the pulse duration of the output pulse to a predetermined maximum duration or set the pulse cycle of the output pulse to a predetermined minimum cycle.

Other objects and features will be clarified from the following description with reference to attached drawings.

BRIEF DESCRIPTION OF THE DRAWINGS

FIG. 18 is a timing chart showing characteristics of the supply voltage, the charging signal from the charging signal generator, the strobo pulse signal from the strobo pulse signal generator and the charging voltage across the main capacitor in the camera system with the fifth embodiment of the strobo system in such operation as writing data in a RAM in a CPU, data transfer, writing data in a memory card or the like; and FIG. 19 is a timing chart showing characteristics of the supply voltage, the charging signal from the charging signal generator, the strobo pulse signal from the strobo pulse generator and the charging voltage VMC across the main capacitor in the system with the fifth embodiment of the strobo system when an LCD is turned on.

PREFERRED EMBODIMENTS OF THE INVENTION

Preferred embodiments of the present invention will now be described with reference to the drawings.

Figure 1:
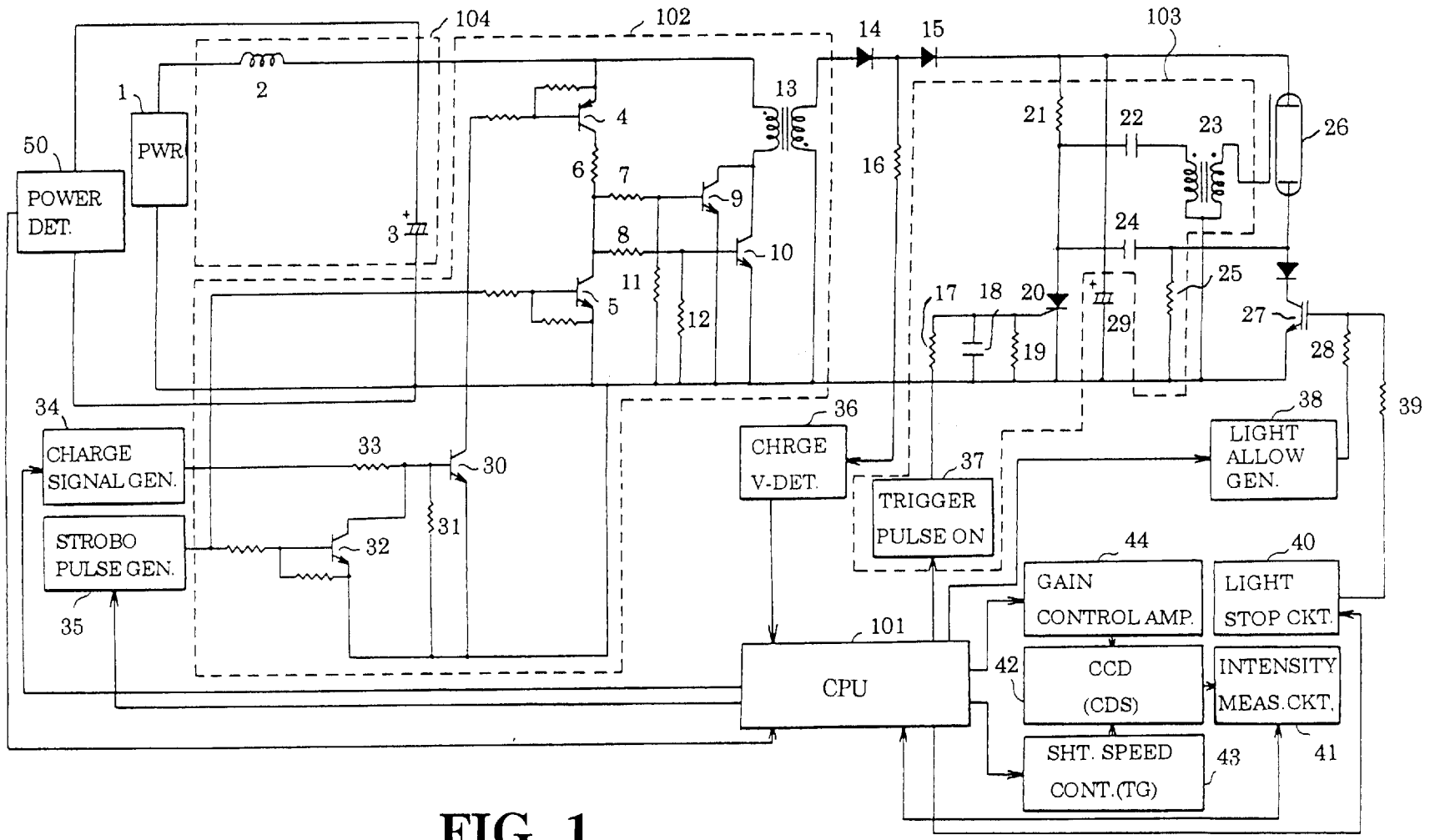
FIG. 1 is a block diagram, partly in a circuit diagram, showing the circuit construction, centered on a first embodiment of the strobo system according to the present invention, of a camera using the same embodiment.

FIG. 1 is a block diagram, partly in circuit diagram, showing the electric circuit construction, centered on a strobo system, of a first embodiment of the camera having the strobo system according to the present invention.

As shown in the Figure, the illustrated camera circuit construction is of a commonly called digital camera, which has functions of taking an image of a scene from an imaging lens (not shown) through a CCD 42 and processing the taken image. The camera has the following strobo system.

The strobo system has an ordinary strobo light emitting function provided by a strobo discharge tube 26, which can emit strobo light based on the charged voltage in a main capacitor 29. The strobo system has a main part which comprises a CPU 101 controlling the strobo system and all the camera circuits, a power supply 1 for supplying a supply voltage to the camera circuits, a power supply filter 104 for the power supply 1, an oscillator 102 of a commonly termed non-self-excited system for generating a pulse voltage for charging the main capacitor 29, the strobo discharge tube 26, the main capacitor 29 charged to a light emission voltage which is applied across the strobo discharge tube 26, a trigger circuit 103 for generating a trigger signal for light emission of the strobo discharge tube 26, an IGBT 27 as a light emission control element for the strobo discharge tube 26, a charging signal generator 34 for generating a signal for controlling the oscillating operation of the oscillator 102 under control of the CPU 101, a strobo pulse signal generator 35, a charging voltage detector 36 for detecting the charging voltage from the oscillator 102, a supply voltage detector 50 for detecting the supply voltage across the power supply 1, a light emission allow signal generator 38 for allowing light emission of the strobo discharge tube 26, and a light emission stop signal generator 40 for generating a signal for stopping light emission of the strobo discharge tube 26.

The camera has, in addition to the above strobo system, the CCD 42 for taking a scene image from an imaging lens (not shown), a gain control amplifier 44 for controlling the gain or amplification factor of the CCD 42, a shutter speed control circuit 43 for controlling the shutter speed (i.e., effective exposure time), and a light intensity measuring circuit 41.

The construction of the strobo system will now be described in greater detail.

The power supply 1 supplies the supply voltage to the strobo system and also to the camera circuits. The power supply filter 104 which is connected to an output terminal on the power supply 1, includes a coil 2 and a capacitor 3, and smoothes the output voltage of the power supply 1.

The oscillator 102 is connected to output terminals of the power supply filter 104, and has the following circuit construction of commonly called non-self-excited system.

The oscillator 102 includes a PNP transistor 4 with the emitter thereof connected via the power supply filter 104 to the positive terminal of the power supply 1. The base of the PNP transistor 4 is connected to the collector of an NPN transistor 30, which has the base thereof connected via a resistor 33 to the charging signal generator 34. The base of the NPN transistor 30 is also connected to the collector of an NPN transistor 32, which has the base thereof connected to the output terminal of the strobo pulse signal generator 35.

The oscillator 102 further includes an NPN transistor 5, which has its base connected to the output terminal of the strobo pulse signal generator 35 and also is connected via a collector resistor 6 to the collector of the PNP transistor 4.

The oscillator 102 still further includes NPN transistors 9 and 10 which have their bases connected via resistors 7 and 8 to the line between the collector of the NPN transistor 5 and the collector resistor 6.

The bases of the NPN transistors 9 and 10 are also connected via resistors 11 and 12 to GND. The oscillator 102 further includes an oscillating transformer 13 which has the primary winding connected to the collectors of the NPN transistors 9 and 10.

The charging signal generator 34 and the strobo pulse signal generator 35 are both controlled by the CPU 101, and control the oscillating operation of the oscillating transformer 13. More specifically, with the oscillator 102 operated according to a strobo pulse signal generated from the strobo pulse signal generator under control of the CPU 101, a predetermined pulse voltage, i.e., pulse current, is supplied to the primary side of the oscillating transformer 13. The oscillating transformer 13 is thus excited for oscillation. This operation will be described later in detail.

A rectifying diode 14 which has the anode thereof connected to the output terminal of the oscillator 102, rectifies the secondary side AC output of the oscillating transformer 13. The cathode of the diode 14 is connected via a leak prevention diode 15 to the anode terminals of the main capacitor 29 and the strobo discharge tube 26.

The cathode of the rectifying diode 14 is also connected via a resistor 16 to the charging voltage detector 36. The charging voltage detector 36 feeds the detection result to the CPU 101.

The trigger circuit 103 includes a resistor 21, a trigger capacitor 22, a trigger coil 23, a boosting capacitor 24, a resistor 25, a thyristor 20, a resistor 19, a capacitor 18, a resistor 17 and a trigger pulse generator 37 connected to the CPU 101, these circuit element being connected in the manner as shown. The trigger coil 23 generates a trigger pulse according to a control signal generated from a trigger pulse generator 37 under control of the CPU 101.

The IGBT 27 has its collector connected to the cathode of the strobo discharge tube 26, and has its base connected via a resistor to the light emission allow signal generator 38 and also via a resistor 39 to the light emission stop signal generator 40.

The supply voltage detector 50, which is connected to the output terminal of the power supply filter 104, is in parallel with the capacitor 3, and always detects the voltage across the power supply 1.

As described before, the charging signal generator 34, the strobo pulse generator 35, the charging voltage detector 36, the trigger pulse generator 37, the light emission allow signal generator 38 and the light emission stop signal generator 40 are connected to and controlled by the CPU 101.

The gain control amplifier 44, the shutter speed control circuit 43 and the light intensity measuring circuit 41 are also connected to and controlled by the CPU 101.

In the above circuit construction, an exciting pulse generator for exciting the oscillating transformer 13 is constituted by the oscillator 102 except for the oscillating transformer 13, the charging signal generator 34, the strobo pulse signal generator 35 and pertinent function parts of the CPU 101.

The charging operation in the first embodiment of the strobo system having the above circuit construction, will now be described with reference to FIGS. 2 to 3.

When a charging signal and a strobo pulse signal are provided as predetermined signals from the charging signal generator 34 and the strobo pulse signal generator 35 under control of the CPU 101, the transistors 4, 5, 9, 10, 30 and 32 and the resistors 6 to 8, 11, 12 and 31 are operated to cause oscillation of the oscillating transformer 13.

More specifically, when the strobo pulse signal generator 35 provides a low active strobo pulse signal in the presence of an "H" level charging signal provided from the charging signal generator 34 under control of the CPU 101, the circuit elements in the oscillator 102 are operated to supply a predetermined pulse voltage to the primary side of the oscillating transformer 13. This pulse voltage, i.e., pulse current, excites the oscillating transformer 13 to cause oscillation thereof.

With the oscillation of the oscillating transformer 13, a secondary side high voltage output is provided therefrom, and coupled through the rectifying side 14 and the diode 15 to the main capacitor 29, thus charging the capacitor 29.

The pulse duration of the strobo pulse signal from the strobo pulse signal generator 35 can be controlled to control the pulse voltage applied to the oscillating transformer 13, thereby controlling the extent of charging of the main capacitor 29.

The charging voltage detector 36 which is connected via the resistor 16 to the cathode of the rectifying diode 14 as described above, detects the charging voltage across the capacitor 29.

With the non-self-excited fly-back system oscillator as in this embodiment, as described before, with as low charging voltage across the main capacitor 29 as zero to several ten volts, i.e., in an initial stage of charging, the oscillating transformer 13 is magnetically saturated depending on its oscillation control, resulting in inrush current flowing in its primary side.

As described before, the magnetic saturation of the oscillating transformer 13 as a cause of the inrush current may be suppressed by limiting the "on" period pulse duration of the pulse voltage to a relatively short period, but continuing the oscillation of the oscillating transformer 13 with such a reduced "on" period pulse duration results in extension of the charging time and is extremely inefficient.

In this connection, it is well known in the art that the attenuation time of the secondary side current in the oscillating transformer 13, is reduced with increasing charging voltage across the main capacitor 29.

The first embodiment of the strobo system is based on this viewpoint, and it features reducing the time of charging the main capacitor while suppressing the inrush current, by controlling the oscillating operation of the oscillating transformer 13 in such a manner as gradually reducing the pulse voltage generation cycle on the basis of charging voltage across the capacitor 29, for instance with increasing charging voltage thereacross.

The control of the oscillating operation of the oscillating transformer 13 in the first embodiment, will now be described with reference to FIGS. 2 to 4.

Figure 2:
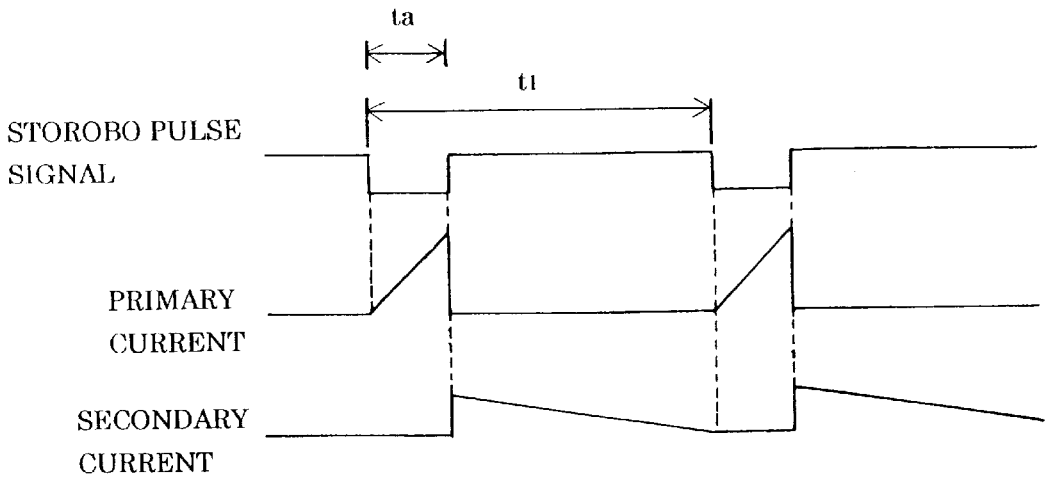
FIG. 2 is a timing chart showing a strobo pulse signal as output signal of a strobo pulse generator and the primary side consumed current and secondary side current in an oscillating transformer in the first embodiment of the strobo system when the charging voltage across a main capacitor is lower than a first predetermined voltage.
Figure 3:
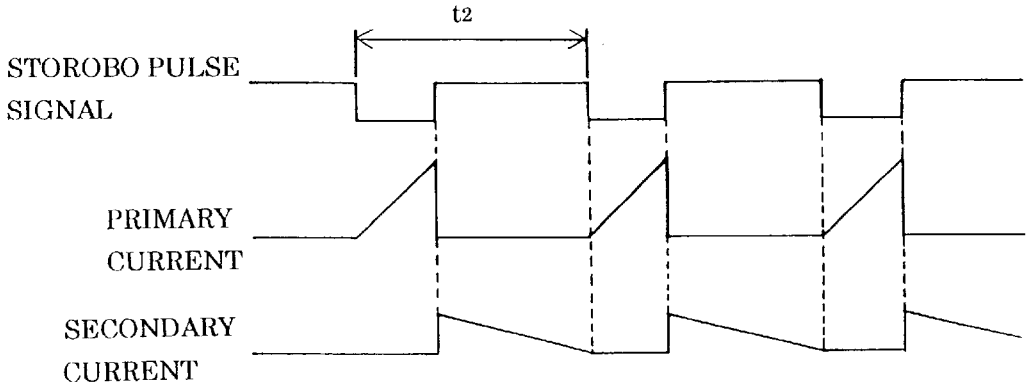
FIG. 3 is a timing chart showing the strobo pulse signal as output signal of the strobo pulse signal generator and the primary side consumed current and secondary side current in the oscillating transformer in the first embodiment of the strobo system when the charging voltage across the main capacitor is lower than a second predetermined voltage.
Figure 4:
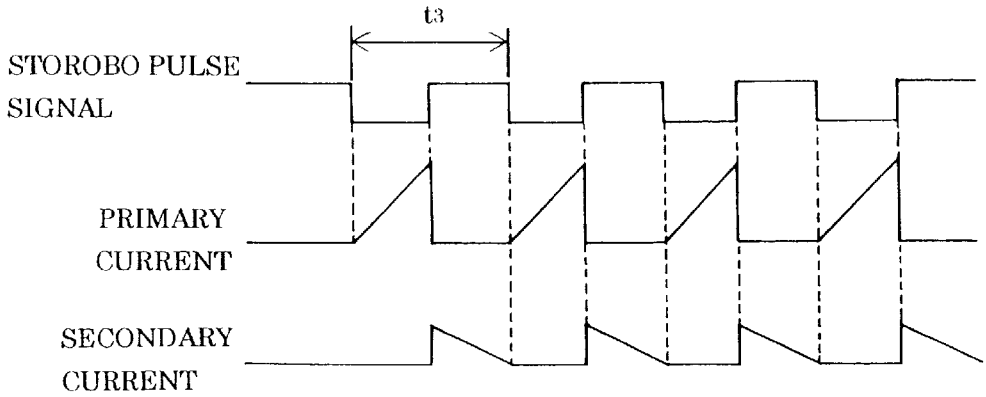
FIG. 4 is a timing chart showing the strobo pulse signal as output signal of the strobo pulse signal generator and the primary side consumed current and secondary side current in the oscillating transformer in the first embodiment of the strobo system when the charging voltage across the main capacitor is higher than a second predetermined voltage.

FIGS. 2 to 4 are timing charts showing the strobo pulse signal as output signal of the strobo pulse signal generator 23 and corresponding primary side consumed current and secondary side current in the oscillating transformer 13. FIG. 2 shows the situation when the charging voltage across the capacitor 29 is lower than a first predetermined voltage, FIG. 3 shows a situation when the charging voltage is lower than a second predetermined voltage, and FIG. 4 shows a situation when the charging voltage is higher than the second predetermined voltage.

As shown in FIG. 2, when the charging voltage VMC across the main capacitor 29, as detected by the charging voltage detector 36, is lower than the first predetermined voltage Av (i.e., when the charging voltage is low), the "on" period pulse duration of the strobo pulse signal from the strobo pulse generator 35, is set to a permissible duration corresponding to the specifications of the oscillating transformer 13, i.e., pulse duration Ta corresponding to a maximum current caused in the oscillating transformer 13 in a range free from magnetic saturation. The pulse cycle of the strobo pulse signal in this instance is designated at t1. This pulse cycle t1 is set under a condition that at least the secondary side current in the oscillating transformer 13 is "0" when the next "on" strobo pulse signal appears.

As shown in FIG. 3, when the charging of the main capacitor 29 has been proceeded to such an extent that the charging voltage VMC across the main capacitor 29, as detected by the charging voltage detector 36, is higher than the first predetermined voltage Av and lower than a second predetermined voltage Bv (i.e., when the charging voltage is intermediate), the pulse cycle of the strobo pulse signal from the strobo pulse signal generator 35, is set to t2 shorter than t1.

As described before, the attenuation time of the secondary side current in the oscillating transformer 13 is reduced with increasing charging voltage across the main capacitor 29. Thus, in the stage when the charging voltage has been increased to the intermediate level, the attenuation time of the secondary side current is shorter than in the state of the low charging voltage level as shown in FIG. 2. It is thus possible to set a shorter pulse cycle of the strobo pulse signal in a range free from the inrush current generation.

The pulse cycle t2 is again set under the condition that at least the secondary side current in the oscillating transformer 13 is "0" when the next "on" strobo pulse signal appears.

As shown in FIG. 4, when the charging of the main capacitor 29 has been proceeded to such an extent that the charging voltage VMC across the capacitor 29, as detected by the charging voltage detector 36, is higher than the second predetermined voltage Bv (i.e., when the charging voltage is high), the pulse cycle of the strobo pulse signal from the strobo pulse generator 35 is set to t3, shorter than t2.

This pulse cycle t3 is again set under the condition that at least the secondary side current in the oscillating transformer 13 is "0" when the next "on" strobo pulse signal appears.

In this embodiment, the "on" period pulse duration ta of the strobo pulse signal is fixed irrespective of the charging voltage across the main capacitor 29 and dependent on the maximum permissible current in the oscillating transformer 13 corresponding to the specifications thereof.

As shown above, in the first embodiment of the strobo system, when the charging voltage across the main capacitor 29 is lower than a predetermined voltage, the "on" period pulse duration and pulse cycle of the strobo pulse signal from the strobo pulse signal generator 35 are set within permissible ranges corresponding to the specifications of the oscillating transformer 13, thereby suppressing the magnetic saturation of the oscillating transformer 13. When the charging voltage across the main capacitor 29 is increased, the pulse cycle of the strobo pulse signal is reduced while holding the pulse cycle thereof unchanged, thereby reducing the charging time.

As an alternative, it is possible to cause gradual reduction of the pulse duration with increasing charging voltage. Furthermore, the pulse cycle may be gradually increased together with the pulse duration.

It is thus possible to reduce the charging time while suppressing the inrush current.

While in the above first embodiment the pulse cycle of the strobo pulse signal has been set by comparing the charging voltage across the main capacitor 29 with predetermined values, this is by no means limitative; for instance, the pulse cycle may be changed continuously so that it always assumes an adequate value determined on the basis of the charging voltage across the main capacitor 29. In this case, it is possible to obtain more efficient charging.

A second embodiment of the strobo system according to the present invention will now be described.

This second embodiment is the same as in the basic circuit construction as the preceding first embodiment, and is different only in that the oscillation of the oscillating transformer 13 is controlled according to the supply voltage of the power supply 1, as detected by the supply voltage detector 50. Here, only the difference of this embodiment will be described, and like part including like construction will not be described.

In the preceding first embodiment, the charging time is reduced while suppressing the inrush current by controlling the oscillation operation of the oscillating transformer 13 according to the charging voltage across the main capacitor 29. In the second embodiment of the strobo system, the oscillating operation of the oscillating transformer 13 is controlled according to the supply voltage of the power supply 1, thereby optimizing the charging efficiency with consequent charging time reduction while suppressing the inrush current.

The control of the oscillating operation of the oscillating transformer 13 in the second embodiment will now be described with reference to FIGS. 5 to 7.

Figure 5:
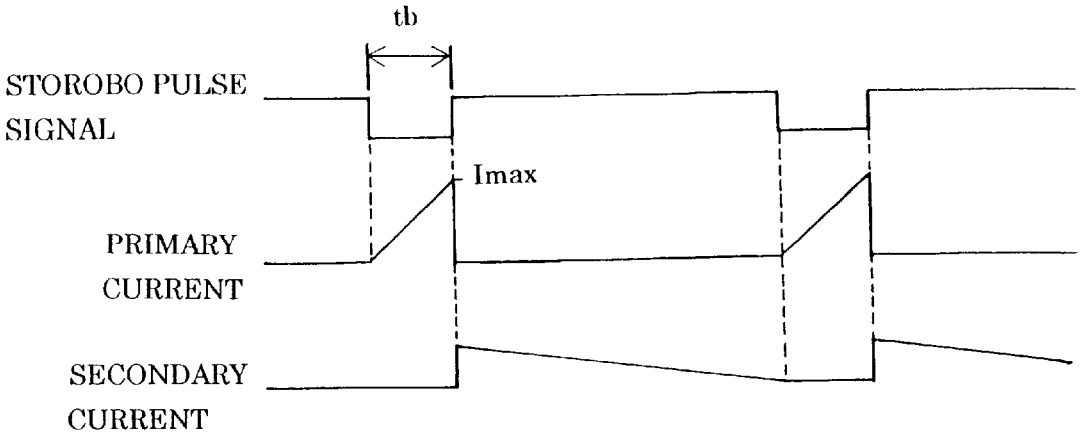
FIG. 5 is a timing chart showing the strobo pulse signal as output signal of the strobo pulse signal generator and the primary side consumed current and secondary side current in the oscillating transformer in a second embodiment of the strobo system when the supply voltage of power supply 1 is higher than a first predetermined voltage.
Figure 6:
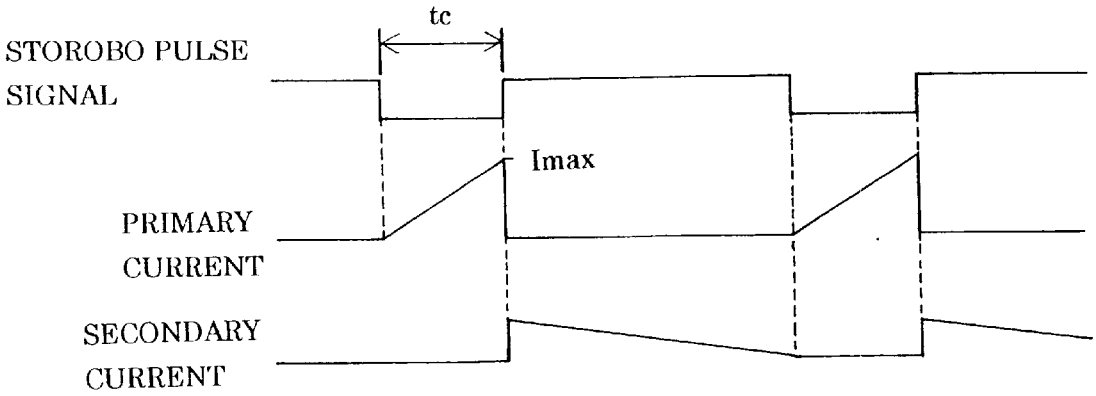
FIG. 6 is a timing chart showing the strobo pulse signal as output signal of the strobo pulse signal generator and the primary side consumed current and secondary side current in the oscillating transformer in the second embodiment of the strobo system when the supply voltage of the power supply 1 is lower than the first predetermined voltage and higher than a second predetermined voltage.
Figure 7:
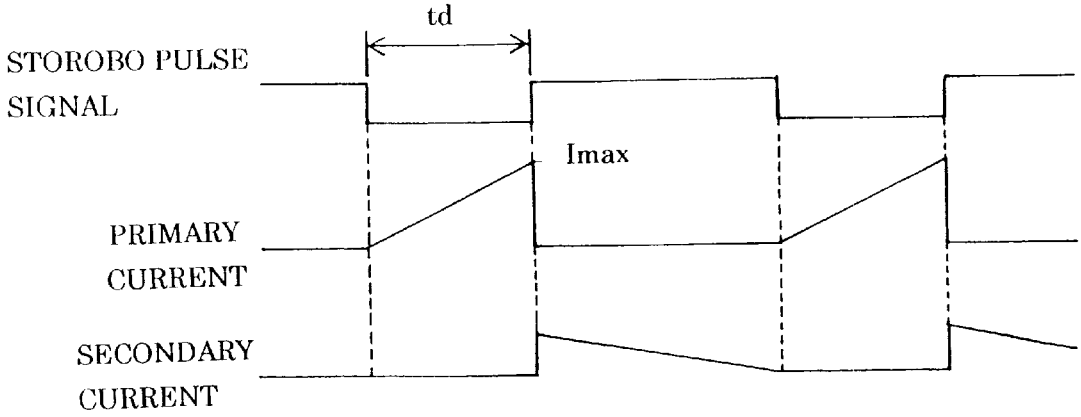
FIG. 7 is a timing chart showing the strobo pulse signal as output signal of the strobo pulse signal generator and the primary side consumed current and secondary side current in the oscillating transformer in the second embodiment of the strobo system when the supply voltage of the power supply 1 is lower than the second predetermined voltage.
Figure 8:
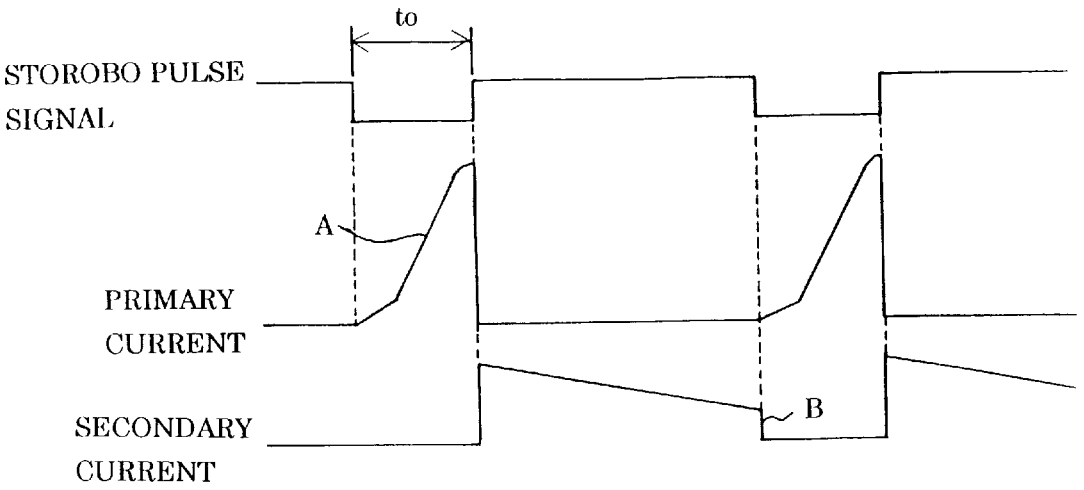
FIG. 8 is a timing chart showing an example of a strobo pulse signal, and the primary side consumed current and secondary side current in an oscillating transformer in a prior art strobo system when the charging voltage across a main capacitor is low.
Figure 9:
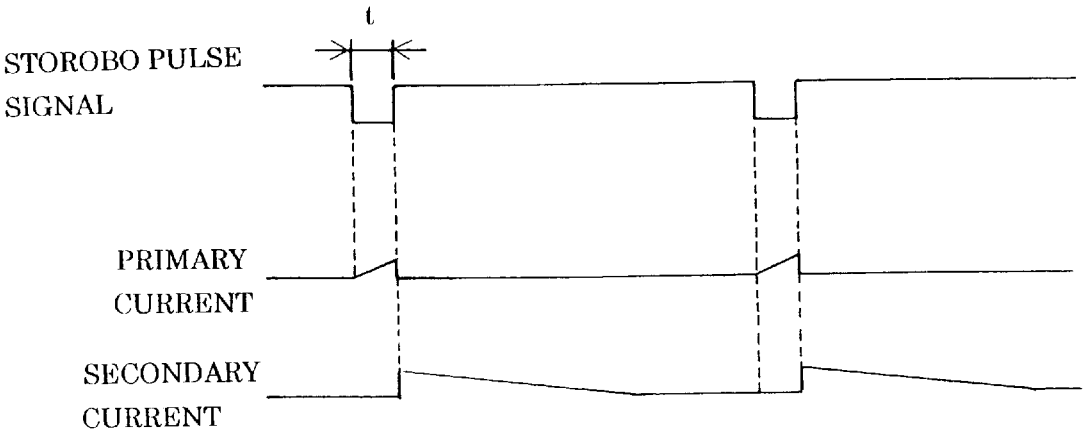
FIG. 9 is a timing chart showing an example of a strobo pulse signal and the primary side consumed current and secondary side current in an oscillating transformer in a prior art strobo system provided with over-current prevention means.

FIGS. 5 to 7 are timing charts showing the strobo pulse signal as output signal of the strobo pulse signal generator 35 and the primary side consumed current and secondary side current in the oscillating transform 13 in the second embodiment. FIG. 5 shows the situation when the supply voltage of the power supply 1 is higher than a first predetermined voltage, FIG. 6 shows the situation when the supply voltage is lower than the first predetermined voltage and higher than a second predetermined voltage, and FIG. 7 shows the situation when the supply voltage is lower than the second predetermined voltage.

Where the "on" period pulse duration of the strobo pulse signal of the strobo pulse signal generator 35 is constant, reduction of the supply voltage reduces the primary side consumed current in the oscillating transformer 13, thus reducing the supplied power and consequently extending the charging time.

The second embodiment of the strobo system is contemplated in view of the above fact, and it features controlling the pulse duration of the strobo pulse signal according to the supply voltage of the power supply 1, thereby obtaining optimum charging efficiency.

Specifically, in the second embodiment of the trobo system the "on" period pulse duration of the strobo pulse signal from the strobo pulse signal generator 35 is varied for charging characteristics control according to the supply voltage of the power supply 1.

As shown in FIG. 5, when the supply voltage of the power supply 1, as detected by the supply voltage detector 50, is higher than a first predetermined voltage (i.e., when the supply voltage is high), the "on" period pulse duration of the strobo pulse signal from the strobo pulse signal generator 35, is set to a permissible duration corresponding to the specifications of the oscillating transformer 13, i.e., a pulse duration tb corresponding to the maximum consumed current (Imax) in the oscillating transformer 13 in a range free from the magnetic saturation of the oscillating transformer 13. This pulse duration is set under a condition that at least the secondary side current in the oscillating transformer 13 is "0" when the next "on" strobo pulse signal appears.

In this way, the charging efficiency when the supply voltage is high can be optimized.

As shown in FIG. 6, when the supply voltage of the power supply 1 is reduced from the state shown in FIG. 5 and detected by the supply voltage detector 50 to be lower than the first predetermined voltage (i.e., when the supply voltage is intermediate), the "on" period pulse duration of the strobo pulse signal from the strobo pulse signal generator 35 is set to tc corresponding to the maximum consumed current (Imax) corresponding to the supply voltage. This pulse duration is again set under the condition that at least the secondary side current in the oscillating transformer 13 is "0" when the next "on" strobo pulse signal appears.

With reducing supply voltage, the differential coefficient of the change in the primary side consumed current is reduced. Thus, it is desirable from the standpoint of the charging efficiency to extend the "on" period pulse duration of the strobo pulse signal the maximum consumed current (Imax) corresponding to the pulse cycle and the supply voltage flows.

As shown in FIG. 7, when the supply voltage of the power supply 1 is further reduced and detected by the supply voltage detector 50 to be lower than the second predetermined voltage (i.e., when the supply voltage is low), the "on" period pulse duration of the strobo pulse signal from the strobo pulse signal generator 35, is set to td corresponding to the maximum consumed current (Imax), which corresponds to the supply voltage. Again this pulse duration is set under a condition that at least the secondary side current in the oscillating transformer 13 is "0" when the next "on" strobo pulse signal appears.

As shown above, in the second embodiment of the strobo system, when the supply voltage of the power supply 1 is higher than a predetermined voltage, the "on" period pulse duration and pulse cycle of the strobo pulse signal from the strobo pulse signal generator 35 is set, in correspondence to the specifications of the oscillating transformer 13, to a value corresponding to the optimum charging efficiency while suppressing the magnetic saturation of the oscillating transformer 13. Also, when the supply voltage of the power supply 1 is reduced, the "on" period pulse duration of the strobo pulse signal is extended to optimize the charging efficiency and reduce the charging time.

It is possible to cause gradual reduction of the pulse cycle in lieu of or together with the above pulse duration increase.

It is thus possible to optimize the charging efficiency while suppressing the inrush current, thus obtaining consequent charging time reduction.

In the above second embodiment the "on" period pulse duration of the strobo pulse signal is set by comparing the supply voltage of the power supply 1 to predetermined threshold values, but this is by no means limitative; for instance, it is possible to cause the "on" period pulse duration to be changed continuously to optimum values, which are determined on the basis of the supply voltage of the power supply 1. In this case, more efficient charging is obtainable to reduce the charging time.

As has been shown, according to the present invention it is possible to provide a strobo system, which can reduce the time of charging the main capacitor while suppressing the inrush current in the oscillating transformer for charging the main capacitor when causing the oscillation of the transformer in the non-self-excited system.

Now, the magnetic saturation which is a cause of the inrush current, can be suppressed by limiting the "on" period pulse duration of the pulse voltage. However, as described before, continuing the oscillation of the oscillating transformer 13 with a reduced "on" period pulse duration, gives rise to an inconvenience that the charging time is extremely extended.

A third embodiment of the strobo system features prevention of the increase of consumed current or interruption of the system operation from being caused by inrush current, by controlling the oscillating operation of the oscillating transformer 13 according to the charging voltage across the main capacitor 29. The circuit construction of the third embodiment is the same as that of FIG. 1.

The control of the oscillating operation of the oscillating transformer 13 in this embodiment will now be described with reference to FIGS. 10 and 11.

Figure 10:
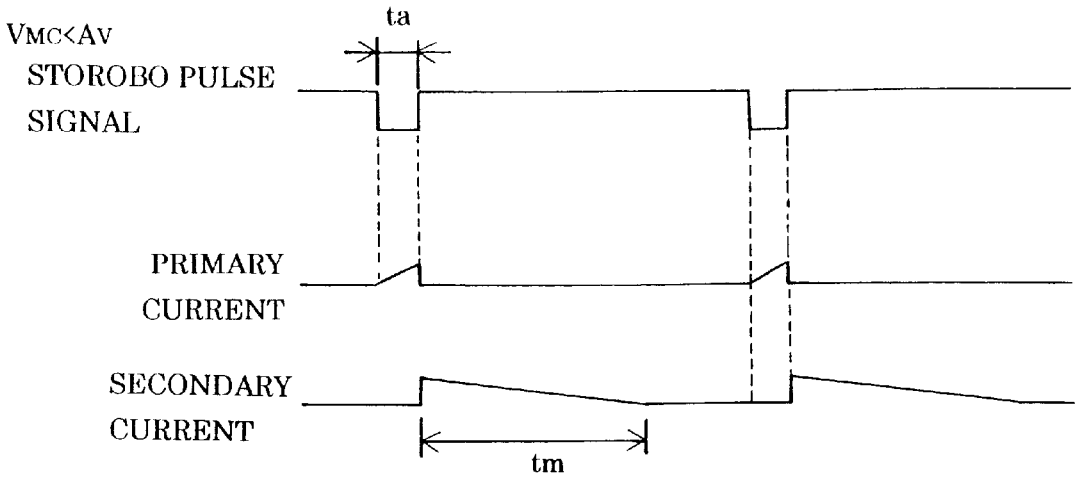
FIG. 10 is a timing chart showing the strobo pulse signal as output signal of the strobo pulse signal generator and the primary side consumed current and secondary side current in the oscillating transformer in the third embodiment of the strobo system when the charging voltage across the main capacitor is lower than a predetermined voltage.
Figure 11:
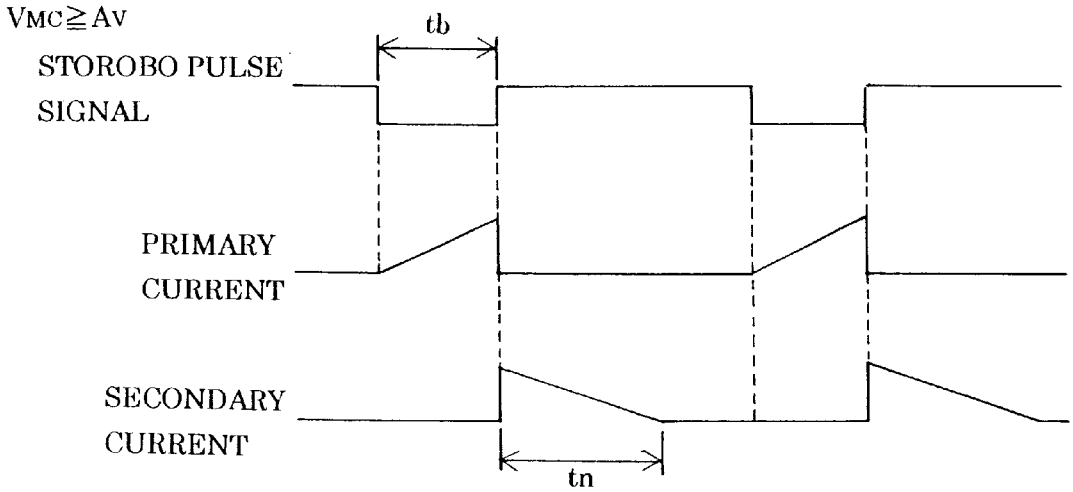
FIG. 11 is a timing chart showing the strobo pulse signal as output signal of the strobo signal generator and the primary side consumed current and secondary side current in the third embodiment of the strobo system when the charging voltage across the main capacitor is higher than a predetermined voltage.

FIGS. 10 and 11 are timing charts showing the strobo pulse signal as output signal of the strobo pulse signal generator 35, and the primary side consumed current and secondary side current in the oscillating transformer 13. FIG. 10 shows the situation when the charging voltage across the main capacitor 29 is lower than a predetermined voltage, and FIG. 11 shows the situation when the charging voltage across the main capacitor 29 is higher than the predetermined voltage.

As shown in FIG. 10, when the charging voltage VMC across the main capacitor 29, as detected by the charging voltage detector 36, is lower than a predetermined voltage Av, the "on" period pulse duration of the strobo pulse signal from the strobo pulse signal generator 35, is set to ta which is so short that the oscillating transformer 13 is not saturated. The pulse duration ta is set under a condition that the secondary side current in the oscillating transformer 13 is reliably "0" until appearance of the next "on" strobo pulse signal.

As shown in FIG. 11, when the charging of the main capacitor 29 has been proceeded so that the charging voltage VMC across the main capacitor 29, as detected by the charging voltage detector 36, reaches the predetermined voltage Av, the "on" period pulse duration of the strobo pulse signal from the strobo pulse signal generator 35 is set to tb longer than ta.

The above operation described with reference to FIGS. 10 and 11, is the operation of the exciting pulse generating circuit noted before.

In this embodiment, the oscillation of the oscillating transformer 13 is controlled by changing the "on" period pulse duration of the strobo pulse signal while holding the pulse cycle thereof fixed irrespective of the charging voltage across the main capacitor 29.

As shown above, in the third embodiment of the strobo system, when the charging voltage across the main capacitor 29 is lower than a predetermined voltage, the "on" period pulse duration of the strobo pulse signal from the strobo pulse signal generator 35 is reduced to suppress the magnetic saturation of the oscillating transformer 13. Also, when the charging voltage across the main capacitor 29 becomes higher than the predetermined voltage, the "on" period pulse duration of the strobo pulse signal is extended to reduce the charging time. It is thus possible to reduce consumed current and ensure stable system operation without extending the charging time.

In the above third embodiment the "on" period pulse duration of the strobo pulse signal was set by comparing the charging voltage across the main capacitor 29 to a predetermined threshold value, but this is by no means limitative; for instance the "on" period pulse duration may be changed continuously to optimum values, which are determined on the basis of the charging voltage across the main capacitor 29. In this case, more efficient charging is obtainable.

A fourth embodiment of the strobo system will now be described.

This fourth embodiment is the same in circuit construction as the preceding third embodiment, and is different only in the control of oscillation of the oscillating transformer 13. Here, only different part will be described, and like parts in construction and so forth are not described.

The fourth embodiment of the strobo system features that, unlike the third embodiment, the oscillating operation of the oscillating transformer 13 is controlled without necessarily depending on the charging voltage across the main capacitor 29, thus ensuring freedom from increase of consumed current or interruption of the system operation due to inrush current while holding the charging time without extension.

The control of the oscillating operation of the oscillating transformer 13 in the fourth embodiment, and hence the operation of the exciting pulse generator noted before in connection with FIG. 1, will now be described with reference to FIGS. 12 and 13.

Figure 12:
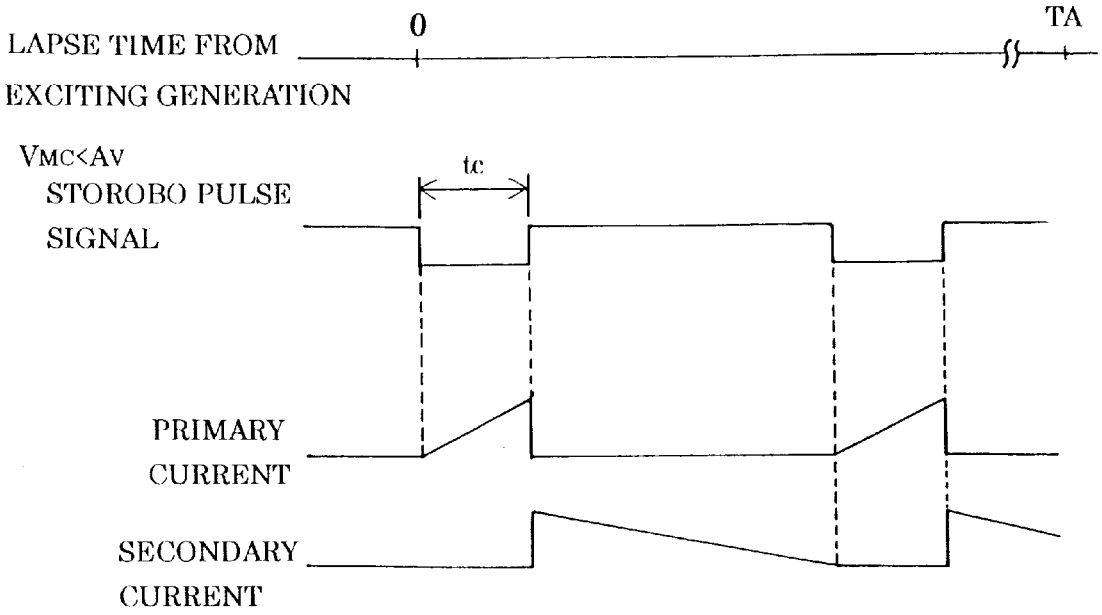
FIG. 12 is a timing chart showing the strobo pulse signal as output signal of the strobo pulse signal generator and the primary side consumed current and secondary current in the oscillating transformer in a fourth embodiment of the strobo system according to the present invention when a predetermined time (TA) has not been passed from the instant of generation of an exciting pulse coupled to the oscillating transformer.
Figure 13:
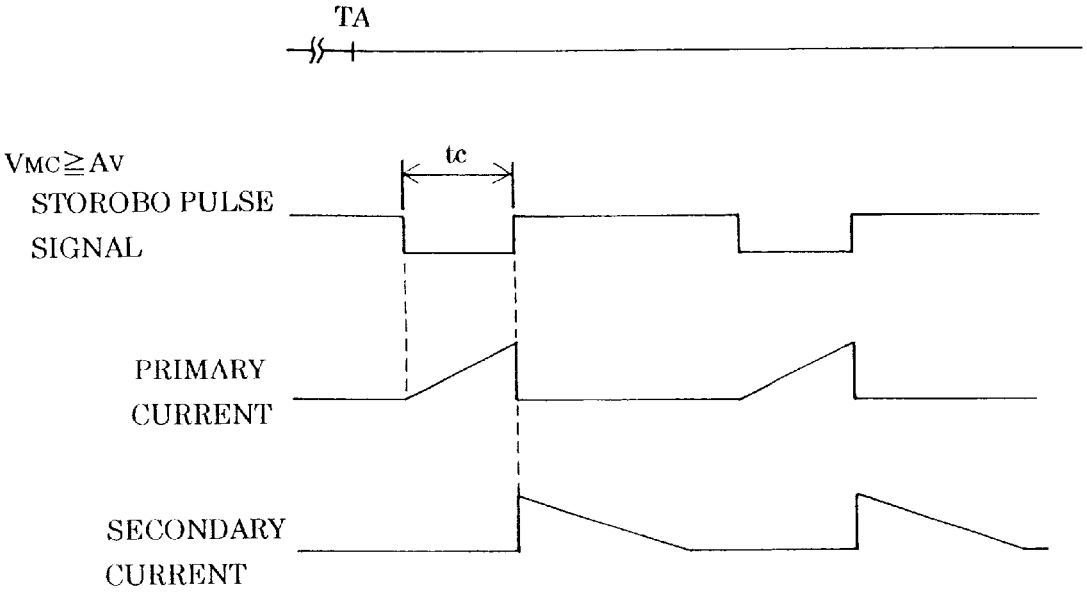
FIG. 13 is a timing chart showing the strobo pulse signal as output signal of the strobo pulse signal generator and the primary side consumed current and secondary current in the oscillating transformer in the fourth embodiment of the strobo system after lapse of the predetermined time (TA) from the instant of generation of the exciting pulse coupled to the oscillating transformer.
Figure 14:
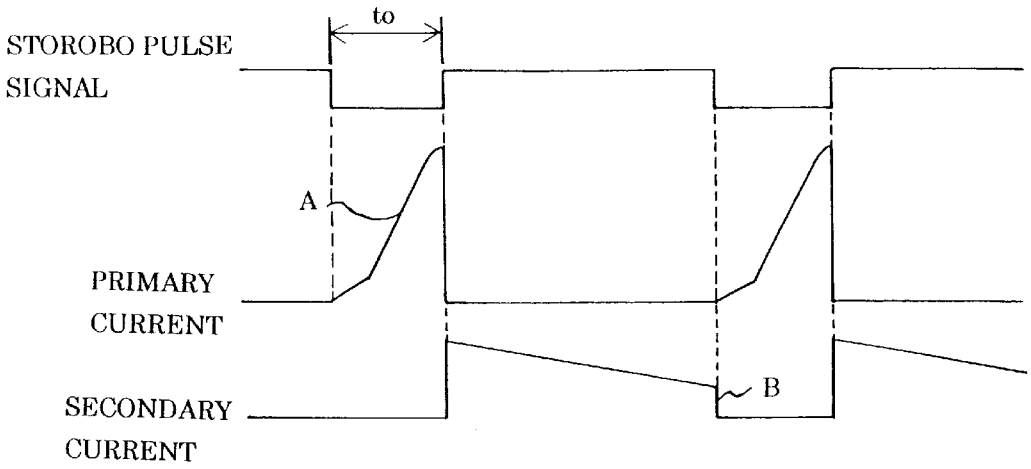
FIG. 14 is a timing chart showing an example of a strobo pulse signal and the primary side current and secondary side current in an oscillating transformer in a prior art strobo system when the charging voltage across a main capacitor is low.

FIGS. 12 and 13 are timing charts showing the strobo pulse signal as output signal of the strobo pulse signal generator 35 and the primary side current and secondary side current in the oscillating transformer 13 in the fourth embodiment.

FIG. 12 shows the situation before lapse of a predetermined time (TA) from the start of generation of an exciting pulse coupled to the oscillating transformer 13. During this time, the charging voltage across the main capacitor 29 is lower than a predetermined voltage.

FIG. 13 shows the situation after lapse of the above predetermined time. At this instant, the charging voltage across the main capacitor 29 become higher than the predetermined voltage.

In the above third embodiment of the strobo system, the "on" period pulse duration of the strobo pulse signal from the strobo pulse signal generator 35 was changed for charging characteristics control according to the charging voltage across the main capacitor 29. This embodiment of the strobo system features that the charging characteristics are controlled without necessary dependence on the charging voltage across the main capacitor 29 but by changing the cycle of the strobo pulse signal from the strobo pulse signal generator 35 before and after the lapse of a predetermined period of time from the outset of an exciting pulse coupled to the oscillating transformer 13, i.e., the outset of the output pulse from the exciting pulse generator noted before.

As shown in FIG. 12, while the above predetermined time has not yet been passed, the "on" period pulse duration of the strobo pulse signal from the strobo pulse signal generator 35 is set to be longer than that when the charging voltage is high as will be described before. The "on" period pulse signal tc of the strobo pulse signal, which is the same as when the charging voltage is high, is set under a condition that the secondary side current in the oscillating transformer 13 is reliably "0" until appearance of the next "on" strobo pulse signal.

As shown in FIG. 13, after the lapse of the predetermined time, the charging voltage VMC across the main capacitor 29 reaches a predetermined voltage Av (i.e., the charging voltage becomes high), and the pulse cycle of the strobo pulse signal from the strobo pulse signal generator 35 is set to be shorter. The "on" period pulse duration remains the same as tc. The rate of charging per unit time is thus increased compared to that when the charging voltage is low.

As shown above, with the fourth embodiment of the strobo system it is possible to ensure stable system operation by suppressing the consumed current without extending the charging time.

This fourth embodiment may not always be carried out independently of the previous third embodiment. For example, it is possible to arrange such that the operations of the third and fourth embodiments can be brought about with adequate priority.

In the above embodiments of the strobo system, the "on" period pulse duration of the strobo pulse signal is sufficiently reduced or the pulse cycle thereof is extended to suppress inrush current only in an initial stage of charging, during which the inrush is prone, while for the other period of time the "on" period pulse duration or the pulse cycle is set such that the maximum permissible current is caused through the oscillating transformer. Thus, it is possible to minimize the efficiency deterioration and prevent system operation failure in the initial stage of charging and also reduce the charging time.

As has been described, according to the present invention it is possible to provide a strobo system, which can suppress inrush current in the oscillating transformer for charging the main capacitor in the oscillation of the oscillating transformer caused in the non-self-excited fly-back system without extending the charging time for charging the main capacitor.

Figure 15:
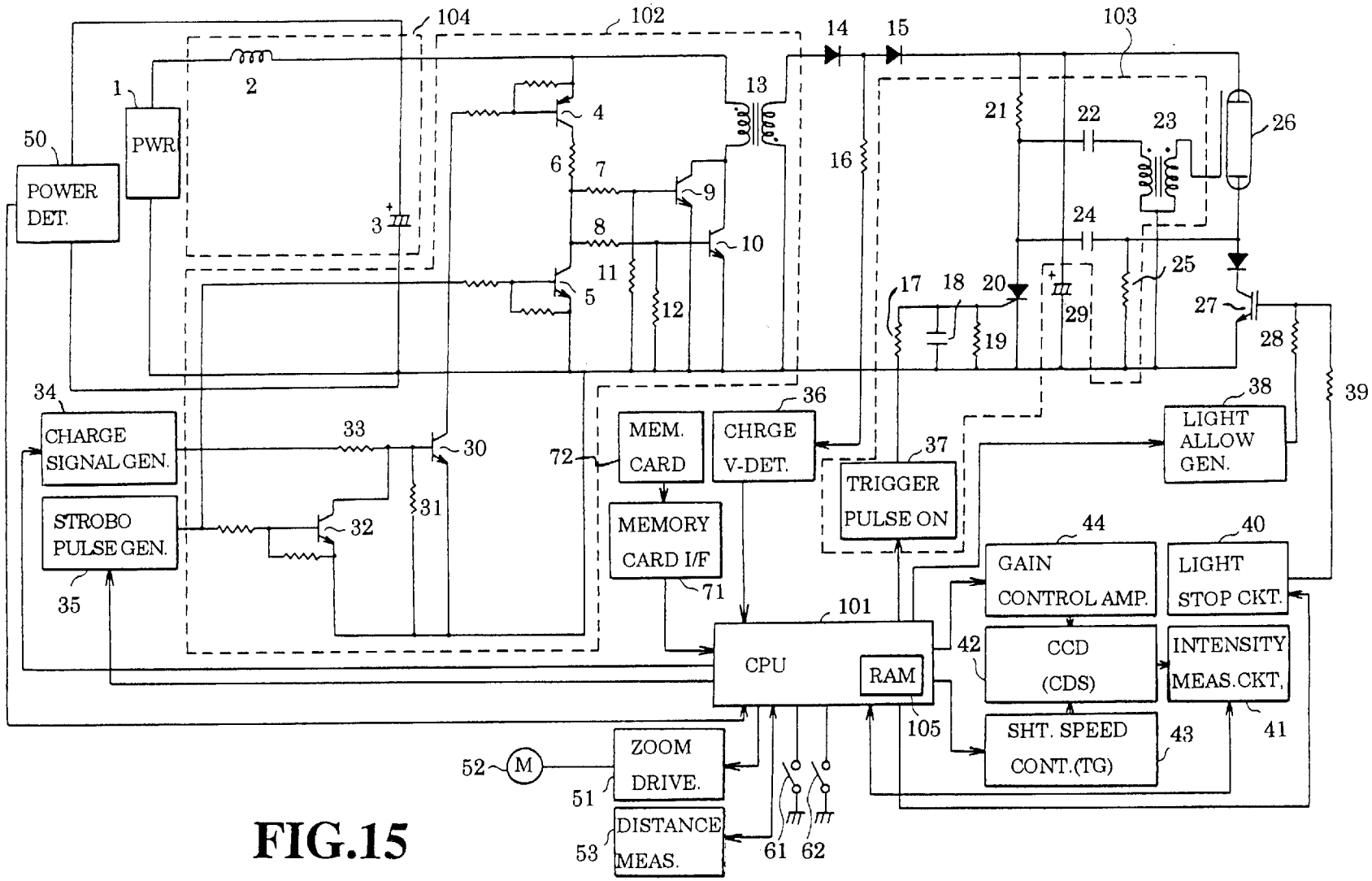
FIG. 15 is a block diagram, partly in a circuit diagram, showing the circuit construction, centered on a fifth embodiment of the strobo system according to the present invention, of a camera using the same embodiment.

FIG. 15 is a block diagram, partly in a circuit diagram, showing the electric circuit construction, centered on a fifth embodiment of the strobo system, of a camera having the strobo system.

The strobo system has an ordinary strobo light emitting function provided by a strobo discharge tube 26, which can emit strobo light based on the charged voltage in a main capacitor 29. The strobo system has a main part which comprises a CPU 101 controlling the strobo system and all the camera circuits, a power supply 1 for supplying a supply voltage to the camera circuits, a power supply filter 104 for the power supply 1, an oscillator 102 of a commonly termed non-self-excited system for generating a pulse voltage for charging the main capacitor 29, the strobo discharge tube 26, the main capacitor 29 charged to a light emission voltage which is applied across the strobo discharge tube 26, a trigger circuit 103 for generating a trigger signal for light emission of the strobo discharge tube 26, an IGBT 27 as a light emission control element for the strobo discharge tube 26, a charging signal generator 34 for generating a signal for controlling the oscillating operation of the oscillator 102 under control of the CPU 101, a strobo pulse signal generator 35, a charging voltage detector 36 for detecting the charging voltage from the oscillator 102, a supply voltage detector 50 for detecting the supply voltage across the power supply 1, a light emission allow signal generator 38 for allowing light emission of the strobo discharge tube 26, and a light emission stop signal generator 40 for generating a signal for stopping light emission of the strobo discharge tube 26.

The camera has, in addition to the above strobo system, the CCD 42 for taking a scene image from an imaging lens (not shown), a gain control amplifier 44 for controlling the gain or amplification factor of the CCD 42, a shutter speed control circuit 43 for controlling the shutter speed (i.e., effective exposure time), and a light intensity measuring circuit 41.

A 1-st release button for generating a photographing preparation start signal and a 2-nd release button 62 for generating a photographing operation start signal, are connected to the CPU 101.

A zoom motor drive circuit 51 for driving a zoom motor 52 for driving a zoom lens (not shown) and a distance measuring circuit 53 having a well-known construction, are connected to the CPU 101. A memory card 72 for storing predetermined data is connected via a memory card I/F circuit 71 to the CPU 101. The CPU 101 includes RAM 105 such as a DRAM.

The construction of the strobo system will now be described in greater detail.

The power supply 1 supplies the supply voltage to the strobo system and also to the camera circuits. The power supply filter 104 which is connected to an output terminal on the power supply 1, includes a coil 2 and a capacitor 3, and smoothes the output voltage of the power supply 1.

The oscillator 102 is connected to output terminals of the power supply filter 104, and has the following circuit construction of commonly called non-self-excited system.

The oscillator 102 includes a PNP transistor 4 with the emitter thereof connected via the power supply filter 104 to the positive terminal of the power supply 1. The base of the PNP transistor 4 is connected to the collector of an NPN transistor 30, which has the base thereof connected via a resistor 33 to the charging signal generator 34. The base of the NPN transistor 30 is also connected to the collector of an NPN transistor 32, which has the base thereof connected to the output terminal of the strobo pulse signal generator 35.

The oscillator 102 further includes an NPN transistor 5, which has its base connected to the output terminal of the strobo pulse signal generator 35 and also is connected via a collector resistor 6 to the collector of the PNP transistor 4.

NPN transistors 9 and 10 have bases connected via resistors 7 and 8 to the collector of the NPN transistor 5.

The bases of the NPN transistors 9 and 10 are also connected via resistors 11 and 12 to GND. The oscillator 102 further includes an oscillating transformer 13 which has the primary winding connected to the collectors of the NPN transistors 9 and 10.

The charging signal generator 34 and the strobo pulse signal generator 35 are both controlled by the CPU 101, and control the oscillating operation of the oscillating transformer 13. More specifically, with the oscillator 102 operated according to a strobo pulse signal generated from the strobo pulse signal generator under control of the CPU 101, a predetermined pulse voltage, i.e., pulse current, is supplied to the primary side of the oscillating transformer 13. The oscillating transformer 13 is thus excited for oscillation. This operation will be described later in detail.

A rectifying diode 14 which has the anode thereof connected to the output terminal of the oscillator 102, rectifies the secondary side AC output of the oscillating transformer 13. The cathode of the diode 14 is connected via a leak prevention diode 15 to the anode terminals of the main capacitor 29 and the strobo discharge tube 26.

The cathode of the rectifying diode 14 is also connected via a resistor 16 to the charging voltage detector 36. The charging voltage detector 36 feeds the detection result to the CPU 101.

The trigger circuit 103 includes a resistor 21, a trigger capacitor 22, a trigger coil 23, a boosting capacitor 24, a resistor 25, a thyristor 20, a resistor 19, a capacitor 18, a resistor 17 and a trigger pulse generator 37 connected to the CPU 101, these circuit element being connected in the manner as shown. The trigger coil 23 generates a trigger pulse according to a control signal generated from a trigger pulse generator 37 under control of the CPU 101.

The IGBT 27 has its collector connected to the cathode of the strobo discharge tube 26, and has its base connected via a resistor to the light emission allow signal generator 38 and also via a resistor 39 to the light emission stop signal generator 40.

The supply voltage detector 50, which is connected to the output terminal of the power supply filter 104, is in parallel with the capacitor 3, and always detects the voltage across the power supply 1.

As described before, the charging signal generator 34, the strobo pulse generator 35, the charging voltage detector 36, the trigger pulse generator 37, the light emission allow signal generator 38 and the light emission stop signal generator 40 are connected to and controlled by the CPU 101.

The gain control amplifier 44, the shutter speed control circuit 43 and the light intensity measuring circuit 41 are also connected to and controlled by the CPU 101.

The basic charging operation in the fifth embodiment of the strobo system having the above construction will now be described.

When a charging signal and a strobo pulse signal are provided as predetermined signals from the charging signal generator 34 and the strobo pulse signal generator 35 under control of the CPU 101, the transistors 4, 5, 9, 10, 30 and 32 and the resistors 6 to 8, 11, 12 and 31 are operated to cause oscillation of the oscillating transformer 13.

More specifically, when the strobo pulse signal generator 35 provides a low active strobo pulse signal in the presence of an "H" level charging signal provided from the charging signal generator 34 under control of the CPU 101, the circuit elements in the oscillator 102 are operated to supply a predetermined pulse voltage to the primary side of the oscillating transformer 13. This pulse voltage, i.e., pulse current, excites the oscillating transformer 13 to cause oscillation thereof.

With the oscillation of the oscillating transformer 13, a secondary side high voltage output is provided therefrom, and coupled through the rectifying side 14 and the diode 15 to the main capacitor 29, thus charging the capacitor 29.

The pulse duration of the strobo pulse signal from the strobo pulse signal generator 35 can be controlled to control the pulse voltage applied to the oscillating transformer 13, thereby controlling the extent of charging of the main capacitor 29.

Now, charging operation when driving various actuators in the fifth embodiment of the strobo system will be described.

An example of charging control when the zoom motor is operated, will now be described with reference to FIG. 16.

Figure 16:
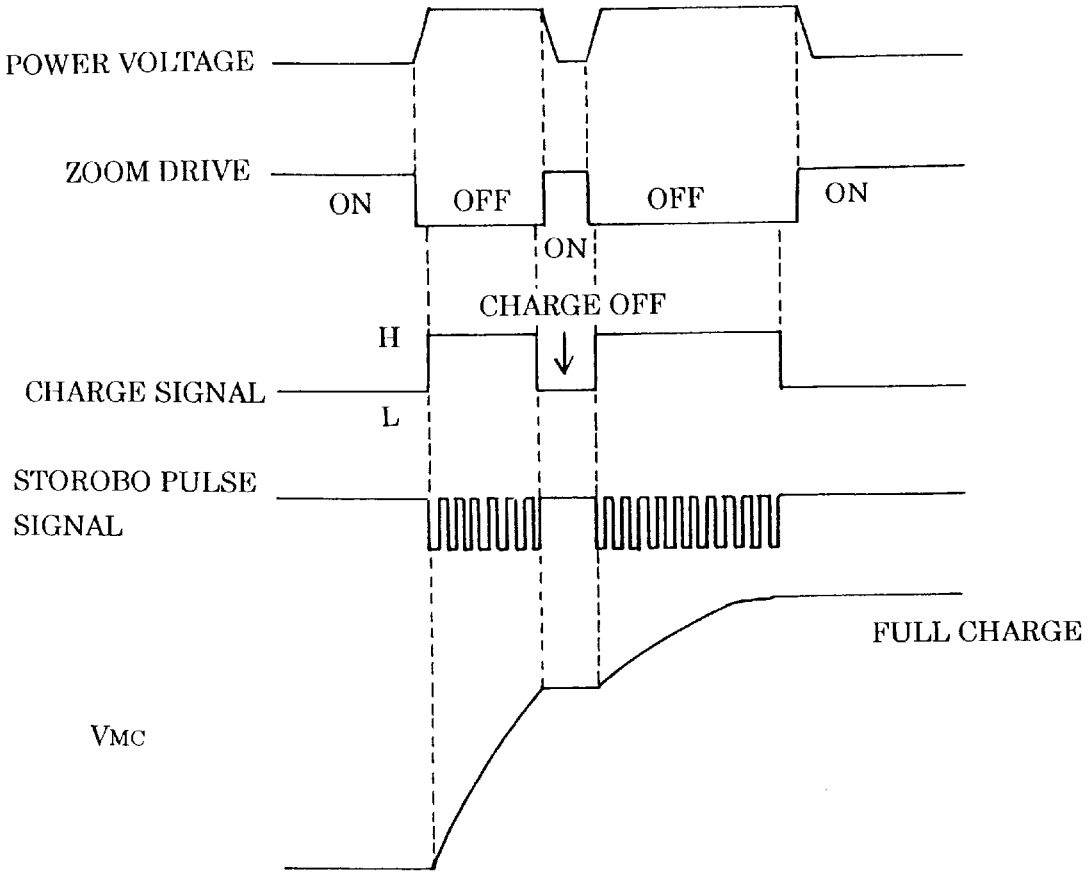
FIG. 16 is a timing chart showing characteristics of the supply voltage, a charging signal from a charging signal generator, a strobo pulse signal from a strobo pulse signal generator and the charging voltage VMC across a main capacitor in the camera system with the fifth embodiment of the strobo system when driving a zoom motor.

FIG. 16 is a timing chart showing characteristics of the supply voltage, the charging signal from the charging signal generator, the strobo pulse signal from the strobo pulse signal generator and the charging voltage VMC of the main capacitor in the camera system with the fifth embodiment of the strobo system when the zoom motor is driven.

As shown in the Figure, when driving the zoom monitor 52, a large current is required, and at this time the supply voltage of the power supply 1 is tentatively reduced. A high load is applied to the common power supply in such case as when driving the zoom motor. When driving the zoom motor, the CPU 101 detects this, and causes inversion of the charging signal from the charging signal generator 34 to "L" level, thus tentatively stopping the charging operation.

At this time, slightly before the start of driving of the zoom lens, the CPU 101 detects generation of a high current load, and turns off the charging signal and also the strobo pulse signal, thus tentatively stopping the charging.

In this way, when a relatively high load is applied to the common power supply, the charging operation is tentatively stopped around this instant under control of the CPU 101.

Thus, application of over-load to the common power supply can be eliminated to eliminate system operation failure or like inconvenience.

An example of charging control right after the depression of the 1-st release button 61 will now be described with reference to FIG. 17.

Figure 17:
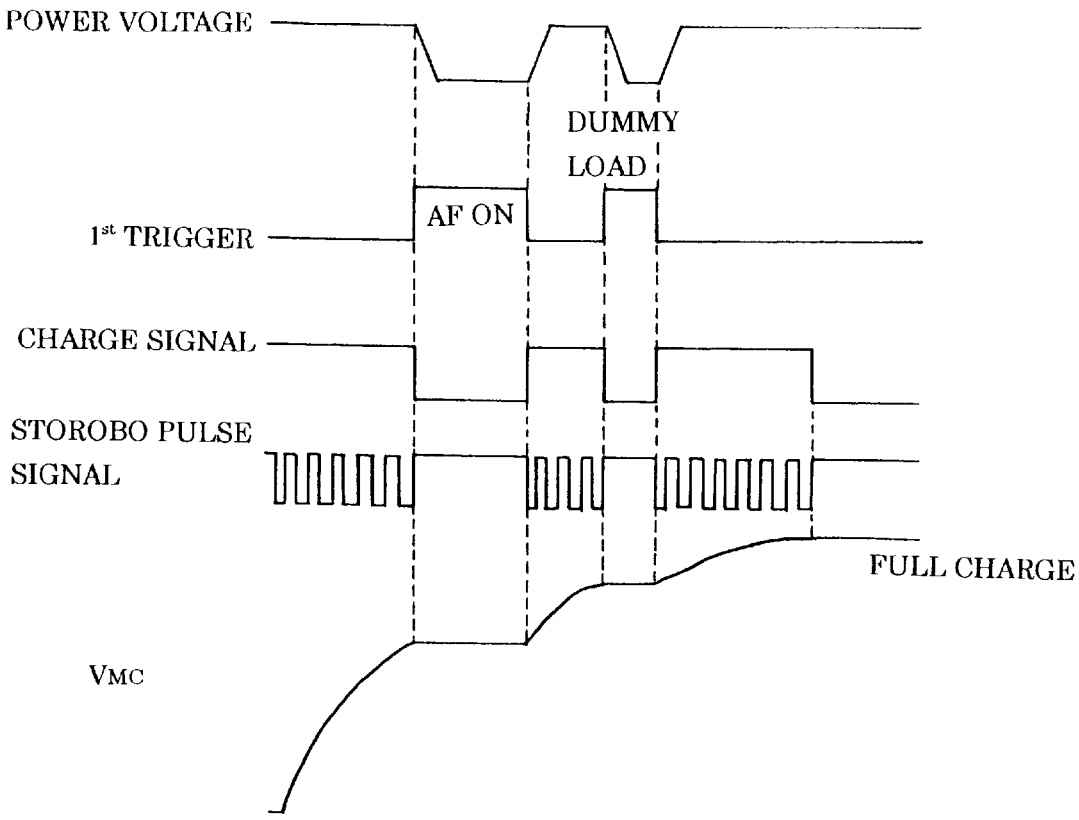
FIG. 17 is a timing chart showing characteristics of the supply voltage, the charging signal from the charging signal generator, the strobo pulse signal from the strobo pulse signal generator and the charging voltage across the main capacitor in the camera system with the fifth embodiment of the strobo system right after depression of as 1-st release button.

FIG. 17 is a timing chart showing characteristics of the supply voltage, the charging signal from the charging signal generator, the strobo pulse signal from the strobo pulse signal generator and the charging voltage VMC of the main capacitor in the camera system with the fifth embodiment of the strobo system in case of, for instance, auto-focus distance measurement right after depression of the 1-ast release button.

As shown in the Figure, when the 1-st release button 61 is depressed for distance measurement in the distance measuring circuit 53, the supply voltage of the power supply 1 is again tentatively reduced. Like the case of driving of the zoom motor, the CPU 101 detects this, and causes inversion of the charging signal form the charging signal generator 34 to "L" level, thus tentatively stopping the charging operation.

Referring to FIG. 17, when the auto-focus is locked after generation of a 1-st trigger signal by depressing the 1-st release button 61, a dammy load (i.e., an adequate load having such specifications as to provide characteristics equivalent in effect to those when a recording operation or the like is executed) is connected to the power supply under control of the CPU 101. The supply voltage reduction status when the dummy load is connected is detected by the power supply detector 50 and the CPU 101, and a check as to whether it is possible to execute normal operation is made also when 2-nd trigger operation is brought about by the depression of the 2-nd release button 62 subsequent to the locking of the auto-focus.

When it is decided as a result of the check that the normal operation is difficult, the 2-nd trigger operation is prohibited. When it is decided that the normal operation is possible, the 2-nd trigger operation is allowed.

An example of charging control when executing an operation of writing data in the RAM 105 in the CPU 101, data transfer or the like, will now be described with reference to FIG. 18.

Figure 18:
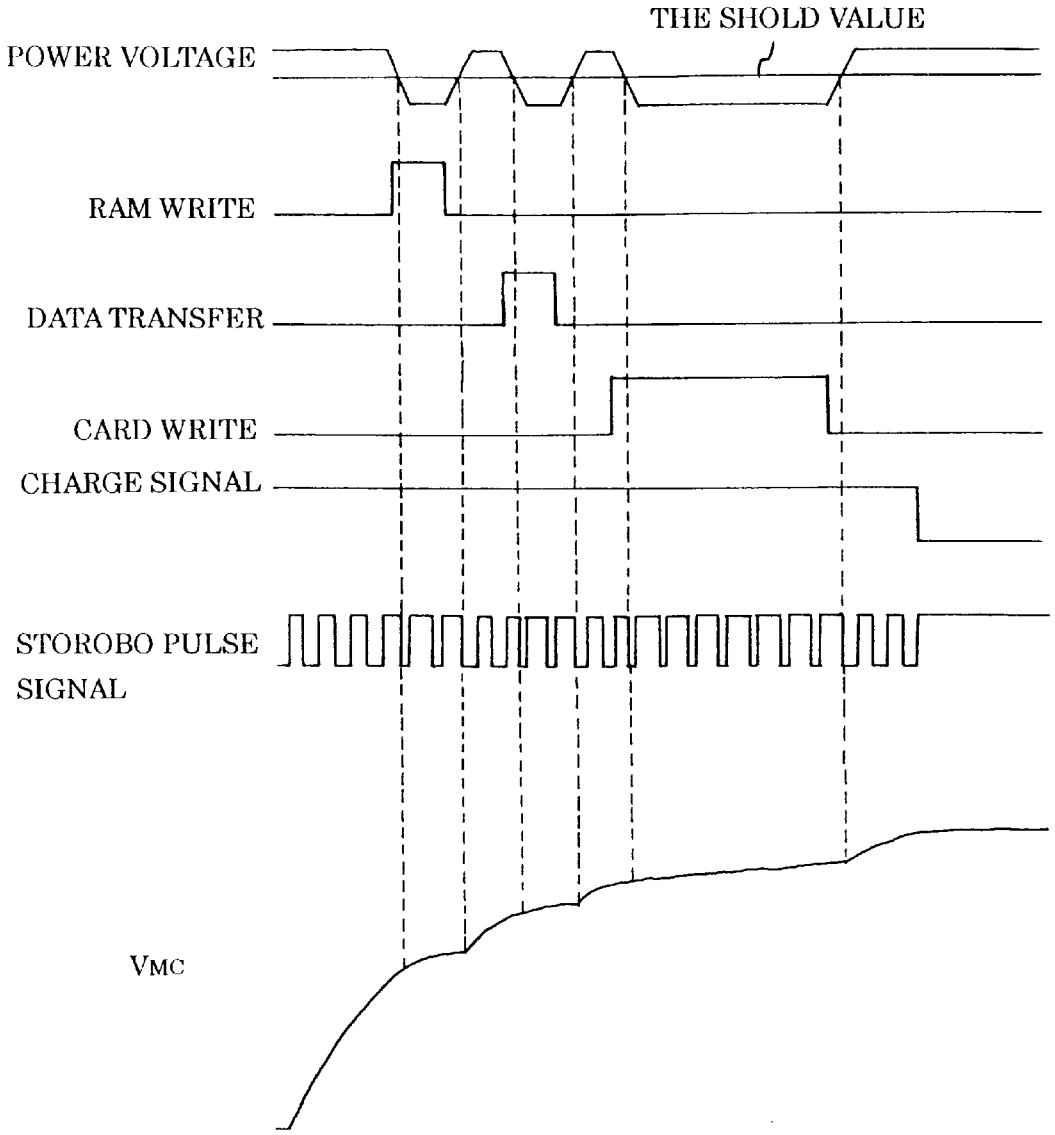

FIG. 18 shows characteristics of the supply voltage, the charging signal from the charging signal generator, the strobo pulse signal from the strobo pulse signal generator and the charging voltage VMC across the main capacitor, when an operation of writing data in the RAM 105 in the CPU 101, data transfer, writing of data in the memory card or the like is executed in the camera system with the fifth embodiment of the strobo system after the 2-nd release button has been turned on.

As shown in the Figure, when an operation of writing data in the RAM 105 in the CUP 101, data transfer, writing data in the memory card or the like is executed, in which case the load applied to the power supply is low compared to the case of driving the zoom motor, the supply voltage is monitored directly, and the oscillation of the oscillating transformer 13 is controlled when and only when the supply voltage becomes lower than a predetermined threshold level.

More specifically, when the load on the power supply is relatively low, the charging signal from the charging signal generator 34 is held "on, i.e., at "H" level, and when and only when the supply voltage becomes lower than the threshold level, the charging rate is reduced by such means as reducing the "on" (i.e., low active) period pulse duration of the strobo pulse signal, thus coping with the overload of the power source.

An example of charging control when an LCD (not shown) is turned on, will now be described with reference to FIG. 19.

Figure 19:
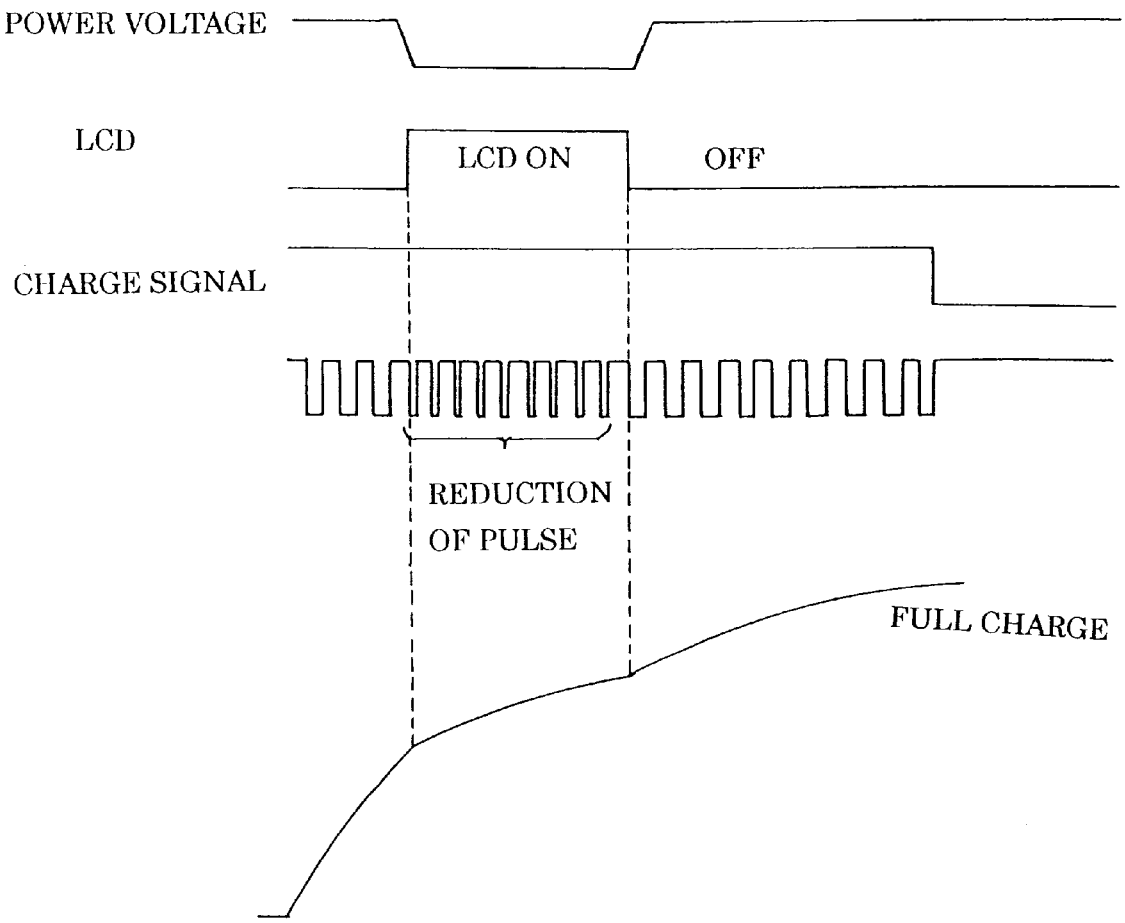

FIG. 19 is a timing chart showing characteristics of the supply voltage, the charging signal from the charging signal generator, the strobo pulse signal from the strobo pulse signal generator and the charging voltage VMC across the main capacitor, when the LCD in the camera system with the fifth embodiment of the strobo system is turned on.

As shown in the Figure, turning on the LCD also causes a reduction of the supply voltage. The load applied to the power supply when the LCD is turned on, is lower than when the zoom motor is driven but higher than when an operation of writing data in the RAM 105 in the CPU 101 is executed.

The CPU 101 can detect the operation of turning on the LCD, and in response to the turning-on of the LCD it reduces the rate of charging by controlling the oscillation of the oscillating transformer 13 by such means as reducing the "on" period pulse duration of the strobo pulse signal.

In this way, system operation failure or like inconvenience can be eliminated without possibility of applying over-load to the common power supply.

In the above embodiment, the power supply state checking means for checking whether or not power is being supplied to a particular load, is adapted to make the check according to the output of the supply voltage detector. Alternatively, it is possible to adopt the CPU to collectively control the state of power supply to the system, so that the check as to whether power is being supplied to the particular load is made on the basis of recognition of the CPU.

Now, a sixth embodiment of the present invention will now be described.

This sixth embodiment of the strobo system is the same as the preceding fifth embodiment, except for that it has a power supply system, in which a commonly called AC adapter or like commercial power supply can be selectively utilized as the power supply for charging the main capacitor and also for the various camera system circuits. The remainder of the circuit construction is the same as in the fifth embodiment, and is not described here in detail.

An AC adapter or like power supply usually has low internal impedance, and its voltage reduction due to a load to it is low compared to the power supply used in the fifth embodiment.

Therefore, when the operation of charging the main capacitor is made concurrently with, for instance, the driving of the zoom motor which dictates a high current load on the power supply, although the supply voltage reduction is slight, a high current is transiently consumed, leading to possible adverse effects of an over-current.

The sixth embodiment of the strobo system is made in view of the above drawback, and it features setting the maximum charging energy in each sequence even in the case of using a low internal impedance power supply, thus preventing over-current.

Specifically, in this instance the CPU 101 in the fifth embodiment of the strobo system (see FIG. 15) is provided with a power supply kind detecting function for detecting that a particular power supply having a relatively low internal impedance, such as an AC adapter, is used. When the power supply kind detecting function detects the use of the particular power supply, the CPU 101 controls the "on" period pulse duration of the strobo pulse signal from the strobo pulse generator 35 to a predetermined maximum duration or controls the pulse cycle of the strobo pulse signal to a predetermined minimum cycle.

In this embodiment, with the setting of the maximum charging energy for each sequence, it is possible to prevent over-current even when the low internal impedance power supply is used.

A seventh embodiment of the present invention will now be described.

This seventh embodiment of the strobo system is basically the same in circuit construction as the previous fifth embodiment except for that a large current supply capacity power supply is used. The remainder of the circuit construction is the same as the fifth embodiment, and are not described in detail.

Adverse effects of over-current may arise not only when the power supply used is a low internal impedance power supply such as an AC adapter as in the previous sixth embodiment, but also when the power supply used has a high current supply capacity and can withstand high load current.

The seventh embodiment of the strobo system is made in view of the above, and it features the maximum charging energy in each sequence even when a high current supply capacity power supply is used, thus preventing over-current.

Specifically, the supply voltage detector 50 in the fifth embodiment of the strobo system (see FIG. 15) detects the supply voltage of the power supply 1, and when the supply voltage reduction is slight even with a high load, the "on" period pulse duration of the strobo pulse signal from the strobo pulse signal generator 35 is set to a predetermined maximum duration, or the pulse cycle of the strobo pulse signal is set to predetermined minimum cycle.

In this embodiment, with the maximum charging energy set for each sequence, it is possible to prevent over-current even in the case of using an excellent current supply capacity power supply.

As has been described in the foregoing, according to the present invention it is possible to provide a strobo system, which can evade over-load on its common power supply when oscillating the transformer for charging the main capacitor in the non-self-excited fly-back system.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A strobo system comprising:

a main capacitor for storing charge for causing light emission from a strobo tube, a transformer with the secondary side thereof connected across the main capacitor for charging the main capacitor, and an exciting pulse generator for exciting the transformer by supplying a pulse voltage to the primary side of the transformer, the exciting pulse generator further comprising charging voltage detecting means for detecting the charging voltage across the main capacitor, the exciting pulse generator being constructed such that, when the charging voltage detected by the charging voltage detecting means is relatively high, output pulse generation bv the exciting pulse generator is controlled to do one of (A) increase the pulse duration of the output pulse and (B) reduce the pulse cycle thereof.

2. A strobo system comprising:

a main capacitor for storing charge for causing light emission of a strobo tube, a transformer with the secondary side thereof connected across the main capacitor for charging the main capacitor, an exciting pulse generator for exciting the transformer by supplying a pulse voltage to the primary side of the transformer, and a power supply circuit for supplying power to a predetermined load inclusive of the exciting pulse circuit, the exciting pulse generator further comprising supply voltage detecting means for detecting the supply voltage of the power supply circuit, the exciting pulse generator being constructed such that, when the supply voltage detected by the supply voltage detecting means is relatively low, output pulse generation by the exciting pulse generator is controlled to do one of (A) increase the pulse duration of the output pulse and (B) reduce the pulse cycle thereof.

3. A strobo system comprising:

a main capacitor for storing charge for causing light emission of a strobo tube, a transformer with the secondary side thereof connected across the main capacitor for charging the main capacitor, an exciting pulse generator for exciting the transformer by supplying a pulse voltage to the primary side of the transformer, and a power supply circuit for supplying power to a predetermined load inclusive of the exciting pulse circuit, the exciting pulse generator further comprising charging voltage detecting means for detecting the charging voltage across the main capacitor, the exciting pulse generator being constructed such that, when the charging voltage detected by the charging voltage detecting means is below a predetermined level, output pulse generation by the exciting pulse generator is controlled to do one of (A) reduce the pulse duration of the output pulse and (B) increase the pulse cycle thereof relative to when the detected charging voltage is above the predetermined level.

4. A strobo system comprising:

a main capacitor for storing charge for causing light emission of a strobo tube, a transformer with the secondary side thereof connected across the main capacitor for charging the main capacitor, an exciting pulse generator for exciting the transformer by supplying a pulse voltage to the primary side of the transformer, and a power supply circuit for supplying power to a predetermined load inclusive of the exciting pulse circuit, wherein the exciting pulse generator is constructed such that output pulse generation by the exciting pulse generator is controlled such that the pulse duration of the output pulse is reduced or the pulse cycle thereof is increased before the lapse of a predetermined time measured from the generation of the output pulse.

5. A strobo system comprising:

a main capacitor for storing charge for causing light emission of a strobo tube, a transformer with the secondary side thereof connected across the main capacitor for charging the main capacitor, an exciting pulse generator for exciting the transformer by supplying a pulse voltage to the primary side of the transformer, and a power supply circuit for supplying power to a predetermined load inclusive of the exciting pulse circuit, the exciting pulse circuit further comprising power supply state checking means for checking whether power has been supplied from the power supply circuit to a particular load other than the predetermined load, the exciting pulse generator being constructed such that, when the power supply state detecting means is detecting that power is being supplied to the particular load, output pulse generation by the exciting pulse generator is controlled to do one of (A) reduce the pulse duration of the output pulse and increase the pulse cycle thereof.

6. The strobo system according to claim 5, wherein the power supply state detecting means is constructed such as to detect, according to the output voltage of the power supply circuit, the power application to the particular load.

7. The strobo system according to claim 5, wherein the power supply detecting means is constructed to detect, on the basis of recognition of a system control unit for collectively controlling the state of power supply in the strobo system, the power application to the particular load.

8. A strobo system comprising:

a main capacitor for storing charge causing light emission of a strobo tube, a transformer with the secondary side thereof connected across the main capacitor for charging the main capacitor, an exciting pulse generator for exciting the transformer by supplying a pulse voltage to the primary side of the transformer, and a power supply circuit for supplying power to a predetermined load inclusive of the exciting pulse circuit, the exciting, pulse generator further comprising supply voltage detecting means for detecting the supply voltage from the power supply circuit, and a power supply kind detecting means for detecting that a particular power supply having a relatively low internal impedance is used, the exciting pulse generator being constructed such that, when the supply voltage detected by the supply voltage detecting means is above a predetermined value, or when the power supply kind detecting means has detected that the particular power supply is used, output pulse generation by the exciting pulse generator is controlled to do one of (A) set the pulse duration of the output pulse to a predetermined maximum duration and (B) to set the pulse cycle of the output pulse to a predetermined minimum cycle.

* * * * *